US005337456A

United States Patent [19]

Clement

[11] Patent Number: 5,337,456

[45] Date of Patent: Aug. 16, 1994

[54] METHOD AND APPARATUS FOR OPENING A WADDING LAP

[75] Inventor: Heinz Clement, Winterthur, Switzerland

[73] Assignee: Rieter Machine Works, Ltd., Winterthur, Switzerland

[21] Appl. No.: 777,797

[22] Filed: Oct. 17, 1991

[30] Foreign Application Priority Data

Oct. 22, 1990 [CH] Switzerland ..... 03368/90

[51] Int. Cl.[5] ..... D01G 19/08; B65H 20/10

[52] U.S. Cl. ..... 19/115 R; 242/553; 242/556; 242/562; 242/564.5

[58] Field of Search ..... 19/115 R, 115 A, 215, 19/229, 231, 233; 242/55.1, 55, 128

[56] References Cited

U.S. PATENT DOCUMENTS

| | | | |
|---|---|---|---|
| 2,559,074 | 7/1951 | Hinson | 19/115 |
| 3,168,308 | 2/1965 | Walton et al. | 271/97 |
| 3,784,190 | 1/1974 | Crawford | 271/309 |
| 3,822,043 | 7/1974 | Pepmeier et al. | 242/55 |
| 4,034,977 | 7/1977 | Jahn | 271/310 |
| 4,419,791 | 12/1983 | Schär | 19/215 |
| 4,531,723 | 7/1985 | Watson | 271/97 X |
| 4,821,971 | 4/1989 | Wanatabe et al. | 242/55 |
| 4,968,018 | 11/1990 | Hoehne et al. | 271/97 |
| 5,016,831 | 5/1991 | Saukkonen | 242/55 |
| 5,027,475 | 7/1991 | Mondini et al. | 19/115 R |
| 5,038,441 | 8/1991 | Mondini et al. | 19/115 R X |
| 5,068,947 | 12/1991 | Beeler | 19/233 X |
| 5,077,865 | 1/1992 | Mondini et al. | 19/115 R |
| 5,095,586 | 3/1992 | Wüst et al. | 19/115 R |

FOREIGN PATENT DOCUMENTS

| | | | |
|---|---|---|---|
| 0317733 | 5/1989 | European Pat. Off. . | |
| 0368059 | 5/1990 | European Pat. Off. . | |
| 0446354 | 9/1991 | European Pat. Off. . | |
| 2362125 | 6/1974 | Fed. Rep. of Germany | 271/97 |
| 4306325 | 11/1964 | Japan | 19/115 R |
| 0207371 | 11/1984 | Japan | 242/55 |
| 3042923 | 2/1988 | Japan | 19/115 R |
| 0398391 | 3/1966 | Switzerland . | |

OTHER PUBLICATIONS

IBM Technical Disclosure Bulletin, Balder et al, "Diverted Flow Bernoulli Pick-up Device", Oct. 1979, vol. 22 #5.

IBM Technical Disclosure Bulletin, Hamilton, "Paper Detach Device", May 1973, vol. 15 #12.

IBM Technical Disclosure Bulletin, Greuling et al, "Paper Transport Mechanism", Jan. 1973, vol. 15 #8.

*Primary Examiner*—Clifford D. Crowder
*Assistant Examiner*—Ismael Izaguirre
*Attorney, Agent, or Firm*—Francis C. Hand

[57] ABSTRACT

In order to open the start of a wadding from a wadding lap, a current of air is produced by a nozzle in the unrolling direction of the wadding lap substantially tangential of the wadding lap and with a spacing to the periphery of the wadding lap. The current of air is generated across the width of the wadding lap. In addition, a guide plate extends from the nozzle to guide the start of the wadding to a joining apparatus. The nozzle and guide plate are pivotally mounted about an axis of a lap roller to facilitate guidance of the opened start of wadding to the joining apparatus.

21 Claims, 6 Drawing Sheets

METHOD AND APPARATUS FOR OPENING A WADDING LAP

This invention relates to a method and apparatus for opening a wadding lap.

As is known, in combing machines or ribbon lap machines, the following up or joining on of a new lap to the end of the wadding which is running out is carried out manually, after the new lap has been put on a mechanism for unrolling the start of the wadding. It has also been known from German Patent 1,283,718 to provide a device in which a new reserve lap is held in readiness and the start of the new wadding is automatically followed up.

In the past, two techniques have been proposed for the opening of the start of the new wadding. With the first technique, the start of the new wadding is opened by means of a sieve drum which is internally under vacuum (suction) and is laid downwards into a clamping gap of two conveyor rollers for joining onto the end of the wadding which is running out.

With the second technique, the start of the new wadding is blown off by means of a nozzle working in the opposite direction to the direction of unrolling and laid on the end of the wadding which is running out. In this case, the blowing off operation, or the opening of the start of the new wadding, is monitored by a sensor.

The technique employing the sieve drum is, however, relatively troublesome and expensive and brings along the risk of soiling of the sieve drum through fiber fly and other components during a continuous operation. The delivery of the start of the new wadding opened by the sieve drum to the following conveyor rollers can lead to problems, especially as the start of the new wadding hangs down freely on part of the delivery route and is not guided. Through this, the tips of the start of the new wadding are reversed and can come to mass accumulations in the area of the joining position with the end of the wadding which is running out. This reversal of the tips of the start of the new wadding can also lead to uncontrolled air currents in the delivery area.

Likewise, undesirable reversals of the tips can occur where the start of the wadding is blown off. Furthermore, it is difficult to achieve a desirable overlap when joining on with this device.

A device for opening of the start of the wadding is also known from the JP-A-1-292121, and corresponding EPA 0446354 whereby the wadding is sucked up by means of a suction pipe which is adjustable to the lap and brought to overlap an end of the wadding which is running out. In the normal case, this system ensures a positive reception of the new start of the wadding from the lap. However, as soon as the front edge of the start of the new wadding lies transversely to the longitudinal axis of the suction pipe as seen over the width of the lap, only part of the start of the wadding may be grasped and drawn off.

Accordingly, it is an object of the invention to provide an improved technique for opening the start of a new wadding lap.

It is another object of the invention to use a relatively simple and positive opening apparatus for detaching the start of a wadding from a wadding lap.

It is another object of the invention to be able to detach the start of a wadding from a wadding lap in a smooth gentle reliable manner.

Briefly, the invention provides a method and apparatus for opening a wadding lap.

In accordance with the method, a current of air is produced over the width of a wadding lap in a direction substantially tangential of the wadding lap and in spaced relation from the wadding lap in order to generate an air stream in an unrolling direction of the wadding lap which can detach a start of the wadding from the wadding lap.

In addition, after detachment, the start of the wadding is guided into a predetermined position for subsequent conveyance to a joining apparatus.

In accordance with the invention, the current of air flows in a planar pattern, i.e. in the form of a plane surface, in order to produce a constant underpressure area over the entire width of the lap. The current of air which is in the form of an air jet mixes with the surroundings and carries along considerable quantities of air in the direction of the stream (see the paperback by DUBBEL—"Eigenschaften des freien Strahls", <Characteristics of Free Jets>) whereby an air stream exists along the lap, which assures positive opening of the whole start of the new wadding.

The opening can take place by rotating the wadding lap, for example on a pair of lap rollers, whereby the start of the wadding lying on the lap reaches into the area of the air stream. Alternatively, opening may take place through appropriate stationary guiding of the wadding lap, whereby the start of the wadding lying on the lap is positioned in the area of the air stream.

Furthermore, the speed of the current of air can be adjusted. This ensures an optimal setting appropriate to the stage of working at the time.

The apparatus for opening the wadding lap includes a nozzle for producing a current of air over the width of the wadding lap. In this respect, the nozzle is arranged with one or more air outlet openings directed approximately tangentially to the periphery of the wadding lap and in the unrolling direction of the wadding lap. Of note, the term "tangentially" is not to be understood in a limited way as referring exactly to the tangent on the outer circumference of the lap but rather to an angular area enclosed by the tangent and is at least not directed opposite to the unrolling direction.

The outlet openings for the air jet from the nozzle can as well be formed as a continuous slot projecting over the width of the wadding or as holes next to each other with a spacing.

The apparatus also includes a guide surface which acts as an extension of the air outlet openings of the nozzle to ensure positive delivery to the subsequent joining apparatus.

The geometrical arrangement of the air outlet openings with relation to the periphery of the wadding lap and the nozzle in the opening position, because of the dominating air streams as well as the resulting underpressure areas, ensures that the start of the wadding is positively opened after the passage of the lap over the nozzle.

The nozzle may also be adjustably mounted so as to swivel about an axis of a lap roller. This makes possible a simple and certain conveyance of the fresh wadding to a subsequent joining-on position to the end of the wadding which is running out.

For better co-ordination of the reception or joining on operation of the start of the new wadding, the air speed of the air produced through the nozzle during the reception or joining operation can be adjusted. It is advantageous that, with the reception (i.e. opening of the wadding lap), a high nozzle speed should be used and, after a successful reception operation, a lower air speed should be delivered by the air nozzle.

The guide plate may also be provided with a pair of upstanding side walls in order to guide the current of air and the start of the wadding therebetween. These guides serve to limit the lateral widening of the air current and insures that the start of wadding which has been taken up maintains its width and does not break out laterally.

These and other objects and advantages of the invention will become more apparent from the following detailed description taken in conjunction with the accompanying drawings wherein:

FIG. 1 schematically illustrates a lateral view of an apparatus constructed in accordance with the invention in cooperation with a combing machine;

Figure 1:
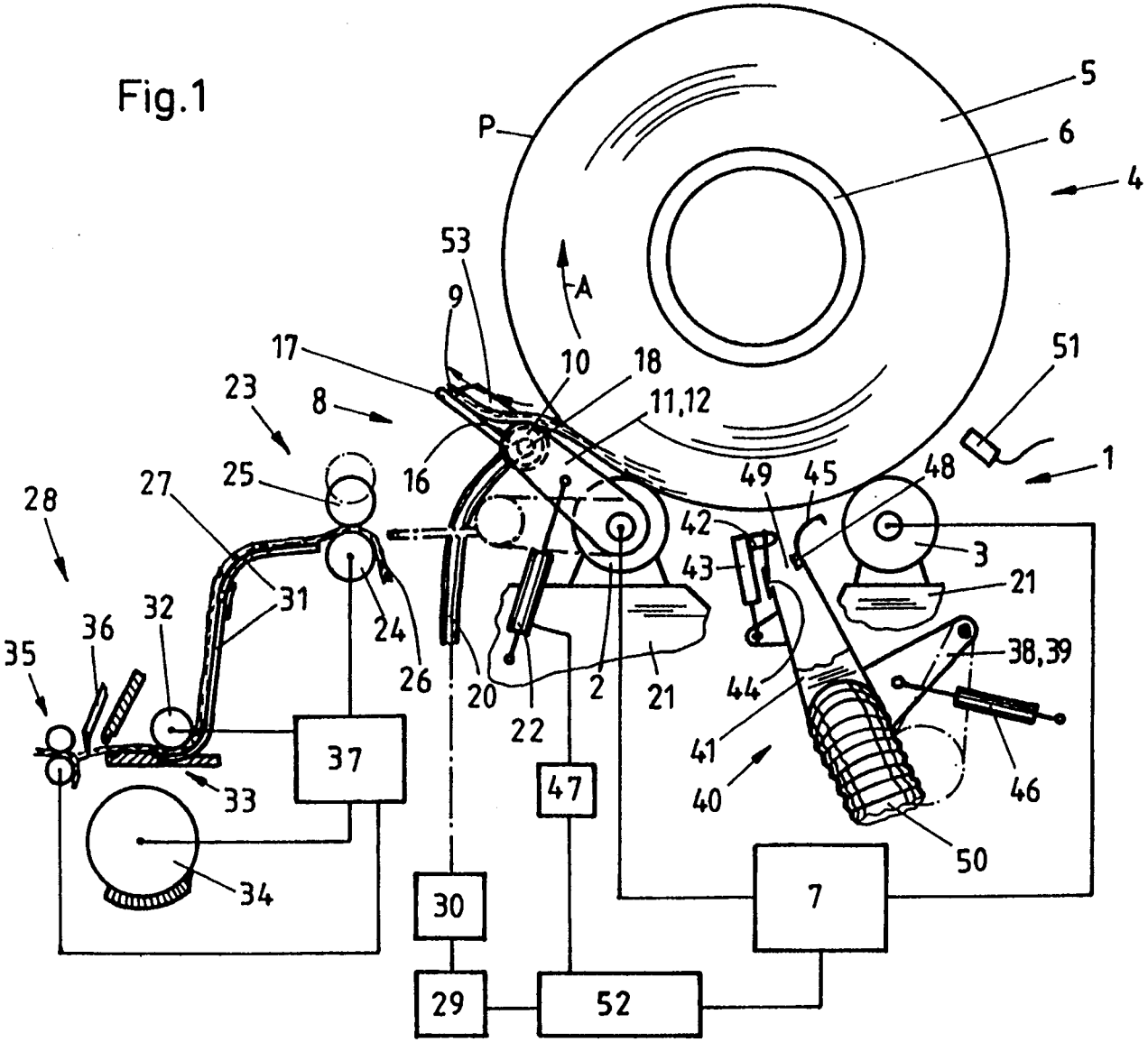

Referring to FIG. 1, a lap receiving means 1, for example in the form of a front lap roller 2 and a rear roller 3, is provided for the mounting of a wadding lap 4 thereon. The wadding lap 4 comprises a wadding 5, which is wound (rolled-up) onto a tube 6 in a conventional manner. The lap rollers 3, 4 are, as indicated schematically, coupled with a drive 7 for rotating the rollers 3, 4 to effect rotation of the lap 4.

Figure 2:
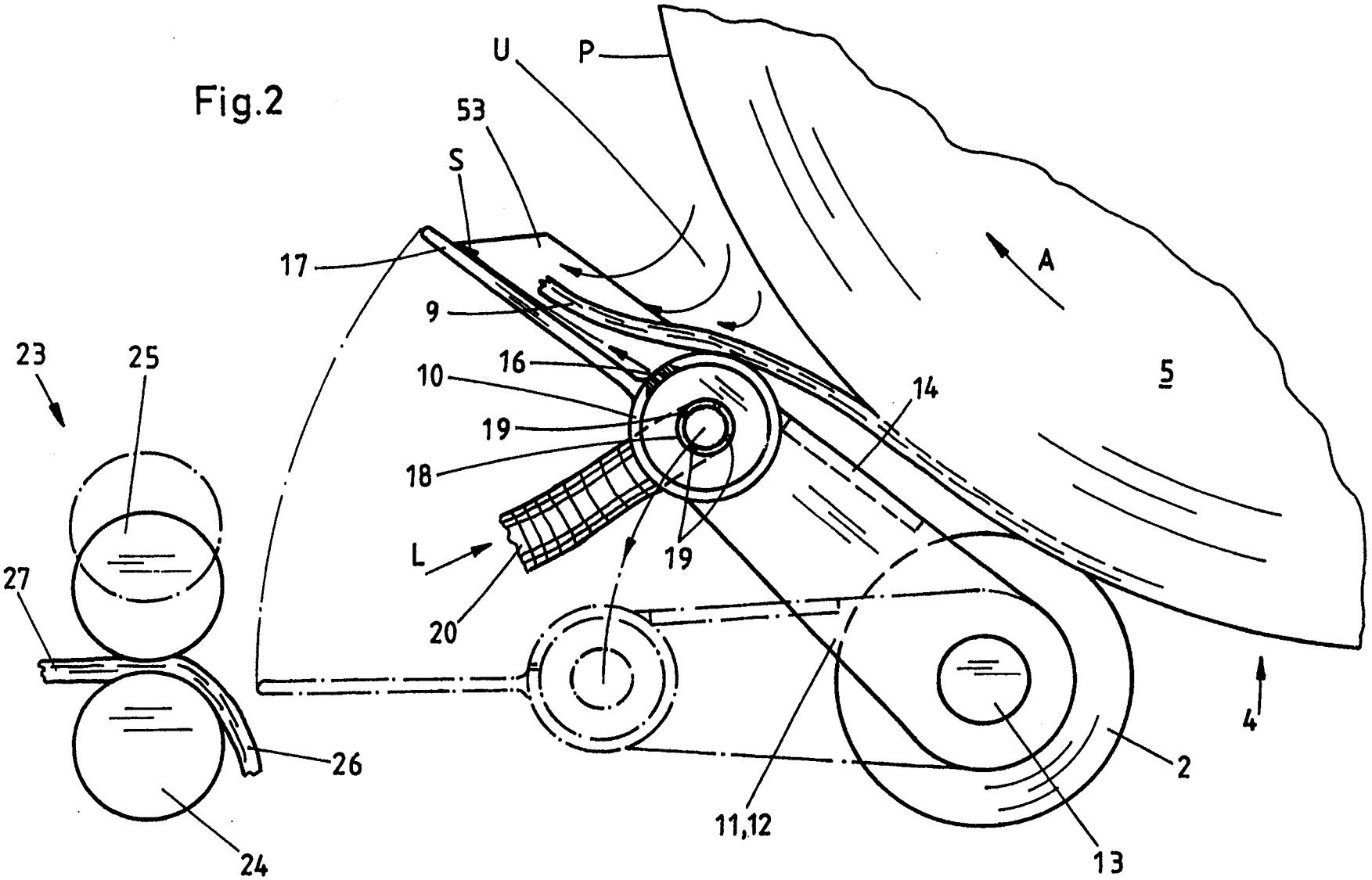
FIG. 2 illustrates an enlarged view of the apparatus for opening a wadding lap in accordance with the invention.
Figure 8:
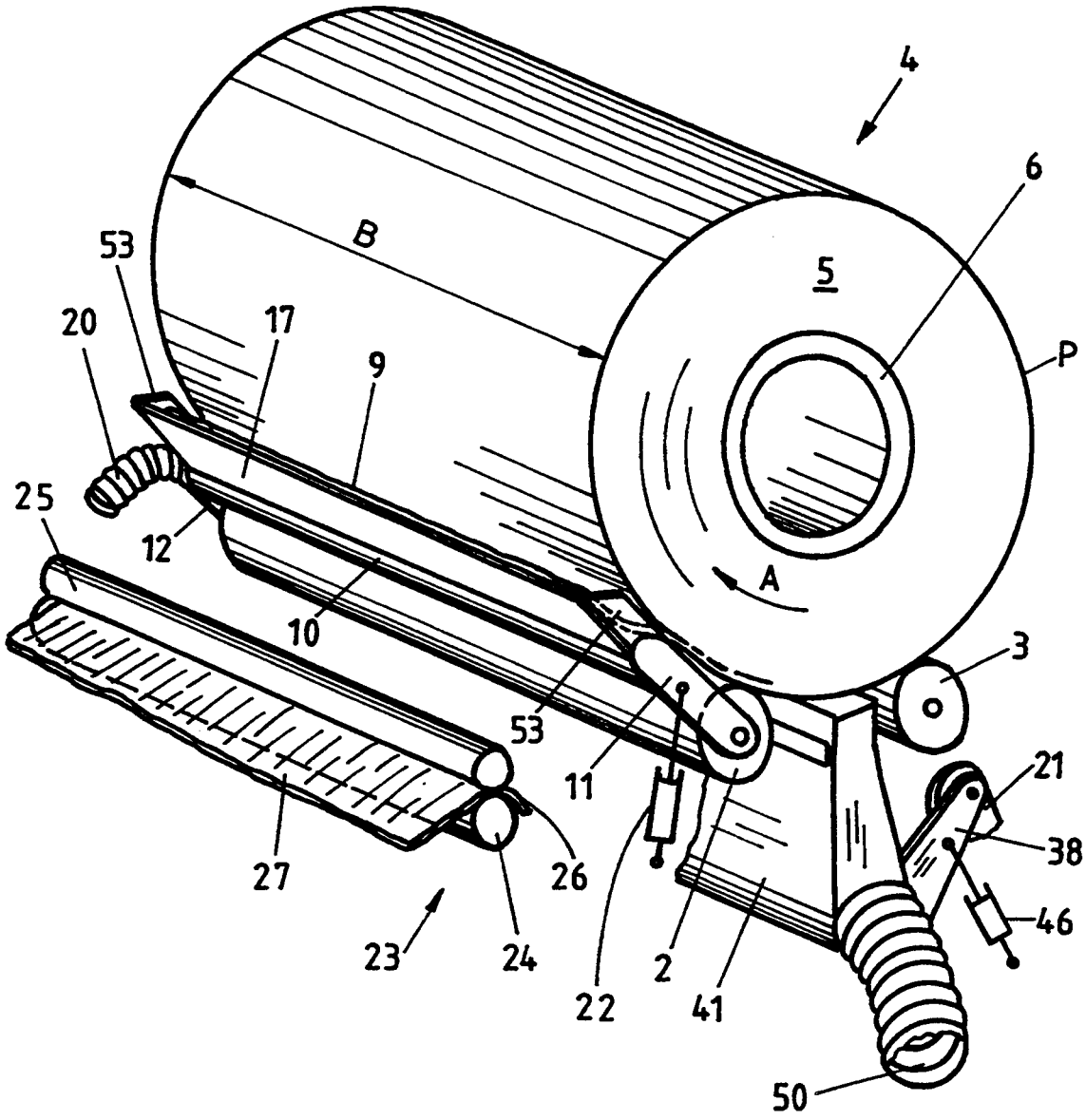
FIG. 8 illustrates a perspective view of the apparatus of FIG. 1.

An opening device 8 is located in the area of the front lap roller 2 for opening the start of the wadding 9. As indicated in FIG. 2, the opening device 8 consists of a tubular nozzle 10 extending at least over the width B of the lap 4 (see FIG. 8). The nozzle 10 is also arranged to swivel on an axis 13 of the front lap roller 2 by means of the two swivel arms 11, 12. The nozzle 10 has an air outlet slot 16, the position of which is shown in FIG. 2 with full lines tangentially and in the unrolling direction A of the lap 4. The air outlet slot 16 extends likewise over the width of the lap 4. Instead of the slot 16, a plurality of outlet openings can be provided next to each other.

A guide plate 17 is fitted on the nozzle 10 to extend from under the slot 16 and likewise extends over the width of the wadding lap. For the-lateral guidance of the start of the wadding 9 or the air stream S, the guide plate 17 is provided with lateral guides or sidewalls 53.

A manifold 18 with the outlet openings 19 is fixed within the tubular nozzle 10 and serves for the supply of pressure air. The manifold 18 is closed on one end and connected with a pressure air pipe 20 on the other end. The pressure air pipe 20 is flexibly fitted, so as to be moved with the swivel movement of the opening device 8. Through the supply of the pressure air via the openings 19 on the periphery of the manifold 18, an even distribution of pressure is ensured in the area of the outlet slot 16.

As can be seen in FIG. 2, the two swivel arms 11, 12 of the nozzle 10 are connected by a plate 14, which, at the same time, forms a guide plate for unrolling the wadding. The nozzle 10 is closed on the lateral front faces, so that the pressure air conveyed via the pressure air pipe 20 can only emerge from the air outlet slot 16.

The swivelling movement of the opening device in the lower position, shown in dash dotted lines in FIG. 2, is carried out by suitable means, such as a hinged cylinder 22 on a schematically indicated support 21. The lap rollers 2, 3 are also carried on this support 21, as well further elements. In the position shown in FIG. 1, the start of the lap 9 is already in an opening position, and is delivered to a joining apparatus 23 in the dash dotted lower position through the swivelling of the opening device 8.

The joining apparatus 23 consists of a lower roller 24 and a pressure roller 25 which can be moved upwards. As can be seen from FIG. 1, an end 26 of the wadding 27 which is running out projects rearwards and downwards from between the roller 24 and the pressure roller 25. The wadding 27 is otherwise being conveyed to a combing device 28 over a guide plate 31. As shown, the wadding 27 is conveyed via a feed roller 32 to a nipper 33. Below the nipper 33, a rotating circular comb 34 is arranged, which combs out the projecting fiber tuft in the clamped position of the nipper. The combed out fiber tuft is drawn off by means of a following detaching roller 35 and then passed during a detaching operation to an appropriately positioned fixed comb 36.

The lower roller 24 of the joining apparatus 23, the feed cylinder 32, the circular comb 34 and the detaching roller 35 are connected with a schematically indicated drive 37 to be driven thereby. The drive 37 is also responsible for the movement of the nipper unit 33; however, the representation has been omitted for reasons of clarity.

For the exact control of the point of time of the opening of the start of the wadding 9, a control 29 for a pressure air source 30 which delivers air to the nozzle 16 for the production of the air stream S, the control of the drive 7 of the lap rollers 2, 3 and the control of a pressure air source 47 for the cylinder 22 for swivelling the nozzle 10, are connected together in a central control unit 52.

Instead of the combing device 28 shown, a reversal device for the wadding could also be used with this joining device being arranged in a ribbon lap machine..

As shown in FIG. 1, a preparation device 40 for the end of the wadding 9 is fitted between the two lap rollers 2, 3 and below the wadding lap 4, on the support 21 which can swivel on swivel arms 38, 39. The preparation device 40 consists here of a suction conduit 41 and of a swivelling clamping part 42 at the inlet of the suction conduit 41. The clamping part 42 swivels on a flexible sleeve 44 by means of a cylinder 43. In the clamping position, the clamping part 42 lies on the opposite wall part 45 of the suction conduit 41. There is a sensor 48 below the clamping position to detect the start of the wadding. The suction conduit 41, which is otherwise closed on all sides up to the suction opening 49, has an opening on a front face, on which a suction pipe 50 is flexibly connected.

Referring to FIGS. 3 to 7, and with reference in detail to FIGS. 1 and 2, the opening operation of the start (leading edge) of the wadding 9 is now described more closely, as well as the delivery to the joining apparatus 23.

Figure 3:
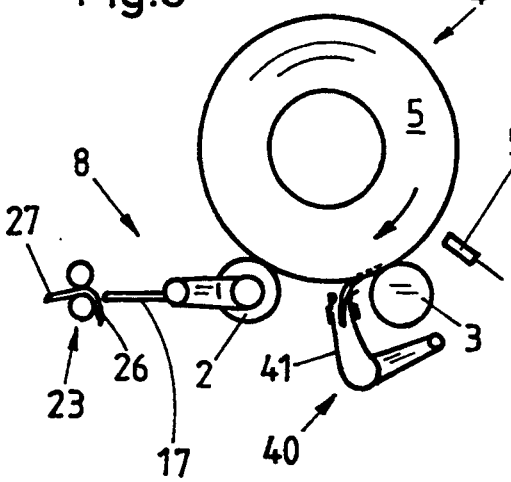
FIG. 3 illustrates a partial view of a wadding lap in preparation for opening of the lap in accordance with the invention.

FIG. 3 shows a position whereby a new wadding lap 4 is already to be found on the lap rollers 2, 3. The wadding lap 4, is manually or automatically placed on the lap rollers 2, 3, after the empty tube of the wadding running out 27 is removed either manually or by means of an ejection device (not shown). An ejection device of this kind could, for example, be formed according to the JP-AS 63-27449. The running out of the old lap is monitored by a sensor 51, which then reacts as soon as the contrast from the white wadding which is running out changes to e.g., a black surface of the tube 6. After the sensor 51 has signalled the running out of the old wadding lap, a device (not shown) is put into operation, which prepares the end of the wadding 26 which is running out for a subsequent joining operation with the start of the new wadding. That is, part of the end of the wadding 26 which is running out is taken up, or detached, by the device which is not shown, in order to maintain an even detaching edge of the wadding running out. A device of this kind is described in U.S. Pat. No. 5,027,475.

After the tube of the old lap has been ejected and the end of the wadding 26 of the wadding running out 27 has been prepared, the wadding 27 is transferred to the position shown in FIG. 3 whereby the end of the wadding 26 is clamped in the joining apparatus 23 and a predetermined piece protrudes in the direction of the new wadding lap 4. The positioning of the end of the wadding 26 running out in the position shown according to FIG. 3, is controlled by sensors (not shown) as mentioned in the U.S. Pat. No. 5,027,475. The further transport of the wadding 27 running out to the subsequent processing unit is now interrupted. That is, the end of the wadding 26 projecting rearwards from the joining apparatus 23 takes up a waiting position for joining onto a start of the new wadding 9.

Figure 4:
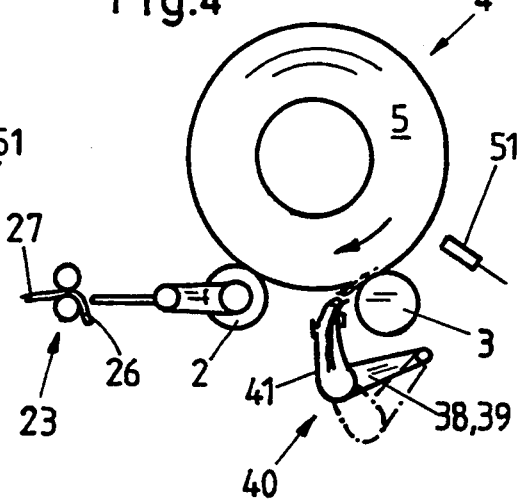
FIG. 4 illustrates a view similar to FIG. 3 of a wadding start being prepared for opening.
Figure 5:
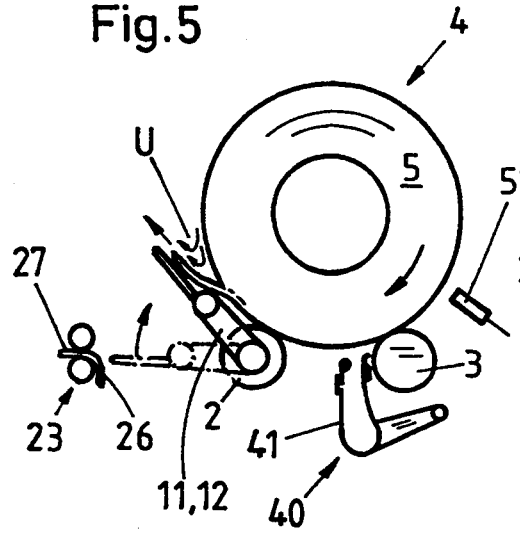
FIG. 5 illustrates the position of a nozzle during opening of a wadding lap in accordance with the invention.

In FIG. 4, the new wadding lap 4 already placed in position on the lap rollers 2, 3, is turned in a clockwise direction, whereby the start of the lap which has not yet been prepared reaches into the area of the preparation device 40 of the suction conduit 41 The underpressure produced in the suction conduit 41 during the rotational movement of the lap 4 has the effect that the start of the new lap 4 is drawn into the conduit 41 in the area of the suction opening 49. The sensor 48 installed in the suction conduit 41 detects the introduction of the start of the lap into the suction conduit 41. As soon as the sensor 48 initiates the signal "Start of wadding present", the clamping part 42 is actuated by the cylinder 43 and clamps the start of the wadding of the wadding lap 4, which has not yet been prepared, onto the wall part 45 of the suction conduit 41.

Now, as shown in FIG. 4, the drive of the lap rollers 2, 3 is reversed, whereby the lap 4 turns in the counterclockwise direction. The lap 4 is now turned through a predetermined angle, whereby the start of the new wadding, firmly held by the clamping part, is separated and, through this, forms a new and prepared start of the wadding 9. The rotational movement of the lap 4 in the counterclockwise is at least, so far that the start of the new wadding 9 is pressed against the outer periphery of the lap 4 by the lap roller 3, so that the start does not release itself independently on the path from the lap roller 3 to the front lap roller 2 by the reversal of the direction of movement. As can likewise be seen in FIG. 4, the suction conduit 41 can swivel into a position, shown with a dash dotted line, for detaching the end of the wadding which has not yet been prepared.

With appropriate fitting of the suction conduit 41 to the lap roller 3, however, swivelling of the conduit 41 for the detaching operation can be avoided, that is, the opposite rotational movement of the lap 4 can suffice for the detaching operation.

After this detaching operation, the detached end of the wadding is sucked off by the suction pipe 50 after the clamping part 42 has opened and, after the suction device has been shut off. The direction of rotation of the lap 4, or the drive of the lap rollers 2, 3, is also again reversed.

By means of the predetermined angle of rotation of the lap 4 with the detaching operation for preparing the new start of the wadding 9, the position of wadding start on the periphery of the lap 4 is exactly determined. That is, the system knows when the start of the wadding 9 reaches into the area of the opening device 8.

As can be seen from FIGS. 2 and 5, the lap again rotates in a clockwise direction, whereby the newly prepared start of the wadding 9 reaches into the area of the opening device 8. As soon as the start of the wadding 9 has passed the point of contact of the lap 4 with the front lap roller 2, the nozzle 10 of the opening device 8 is swivelled from a lower position indicated with dash dotted lines into an upper position by means of the cylinder 22. After this upper position has been reached, pressure air is supplied to the nozzle 10 from the pressure air source 30 via the pressure air pipe 20 and via the manifold 18 and the outlet openings 19. This pressure air now emerges from the air outlet slot 16 and produces an air stream S along the guide plate 17. The air pressure in the manifold 18 amounts to approximately 6 bar at this time.

The pressure air is then applied when the front end of the start of the wadding 9, with the opening device 8 swivelled into the upper position, has passed the air outlet slot 16 of the tubular nozzle 10 and is located with a predetermined spacing to the slot 16. This operation is exactly controlled through the control unit 52. The exact point in time of the supply of pressure air is decisive for the gentle reception of the start of the start of the wadding 9. If the pressure air is started too early, that is to say, when the front edge of the start of the wadding 9 is located at the height of the outlet opening 16, then the previously prepared start of the wadding can be negatively altered through the air streams, whereby the tips of the wadding can be reversed. If the pressure air is applied later, the risk ensues that the start of the wadding 9 is no longer opened from the lap 4.

The air stream S applied along the guide plate 17 effects an underpressure in the space U between the lap X and the air stream S and, because of the surrounding air carried along between the periphery P of the lap and the guide plate 17, an air stream is effected along the lap 4 (opposite to the unrolling direction), through which the start of the wadding 9 is opened from the lap 4. The start of wadding is also laid on the guide plate 17 by means of the pressure relationship existing because of the air stream S on the guide plate 17. Between the guide surface of the guide plate 17 and the wadding, a limiting layer with a hitherto undefined air speed is formed because of the friction between the air jet and the guiding surface. The wadding "swims" on this limiting layer, so that practically no friction exists between the wadding and the guide surface.

As soon as the start of the wadding 9 has been opened from the lap 4, the nozzle 10 is swivelled downwards via the swivel arms 11, 12, by means of the cylinder 22. During this swivelling movement, the pressure roller 25 of the joining apparatus 23 is lifted from the lower roller 24.

Through further rotation of the lap 4, the front edge of the start of the wadding 9 is displaced along the guide plate 17 up to the end of the wadding which is running out. The immediate swivelling away of the nozzle 10 after the opening of the start of the wadding 9 is important for preventing the front edge of the start of the wadding 9 from being possibly displaced rearwards because of the turbulence set up between the end area of the guide surface 17 and the periphery P of the lap 4.

Figure 6:
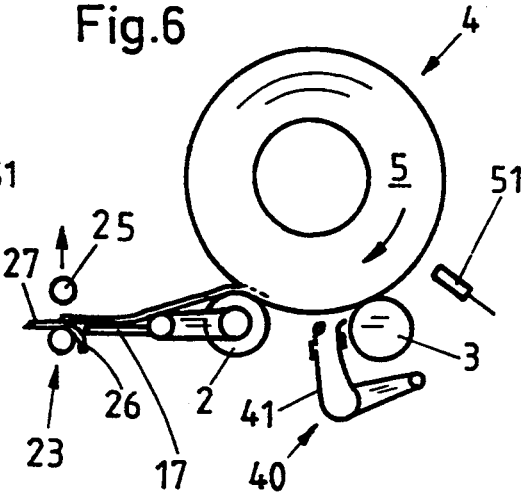
FIG. 6 illustrates a view similar to FIG. 3 of a nozzle and guide plate in position for delivering an opened start of wadding to a joining apparatus.

As can be seen from FIG. 6, the end of the wadding 9 is guided between the clamping position of the roller 24 and the lifted pressure roller 25 and laid at the same time on the end of the wadding 26 which is running out.

In order to avoid disturbing this joining on operation, the pressure of the pressure air applied can be reduced after the successful opening of the end of the wadding 9 from the lap 4. As soon as the end of the wadding 9 has reached the position shown, the pressure roller 25 is again lowered, whereby the end of the new wadding 9 is joined with the end of the wadding 26 running out.

Figure 7:
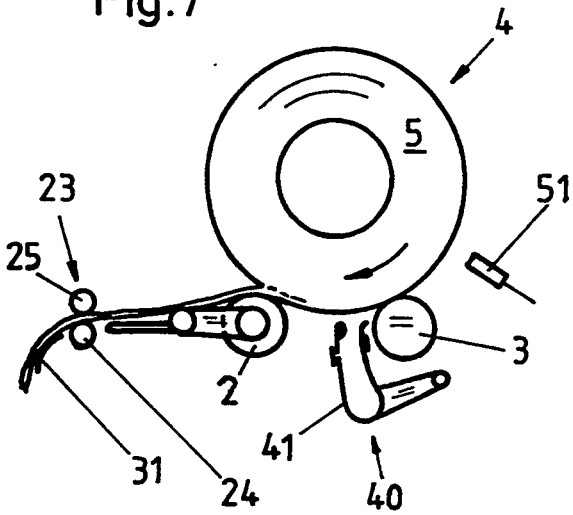
FIG. 7 illustrates a view similar to FIG. 3 of the nozzle and guide plate after joining of a start of wadding to a trailing end of wadding.

After lowering the pressure roller 25, as shown in the FIG. 7, the following wadding processing device, e.g., a combing device 28, including the wadding feeding device 32, is restarted and the supply of pressure air to the nozzle 10 is interrupted.

The wading is now continuously fed via the guide plate 31 to the subsequent wadding processing installation.

Figure 9:
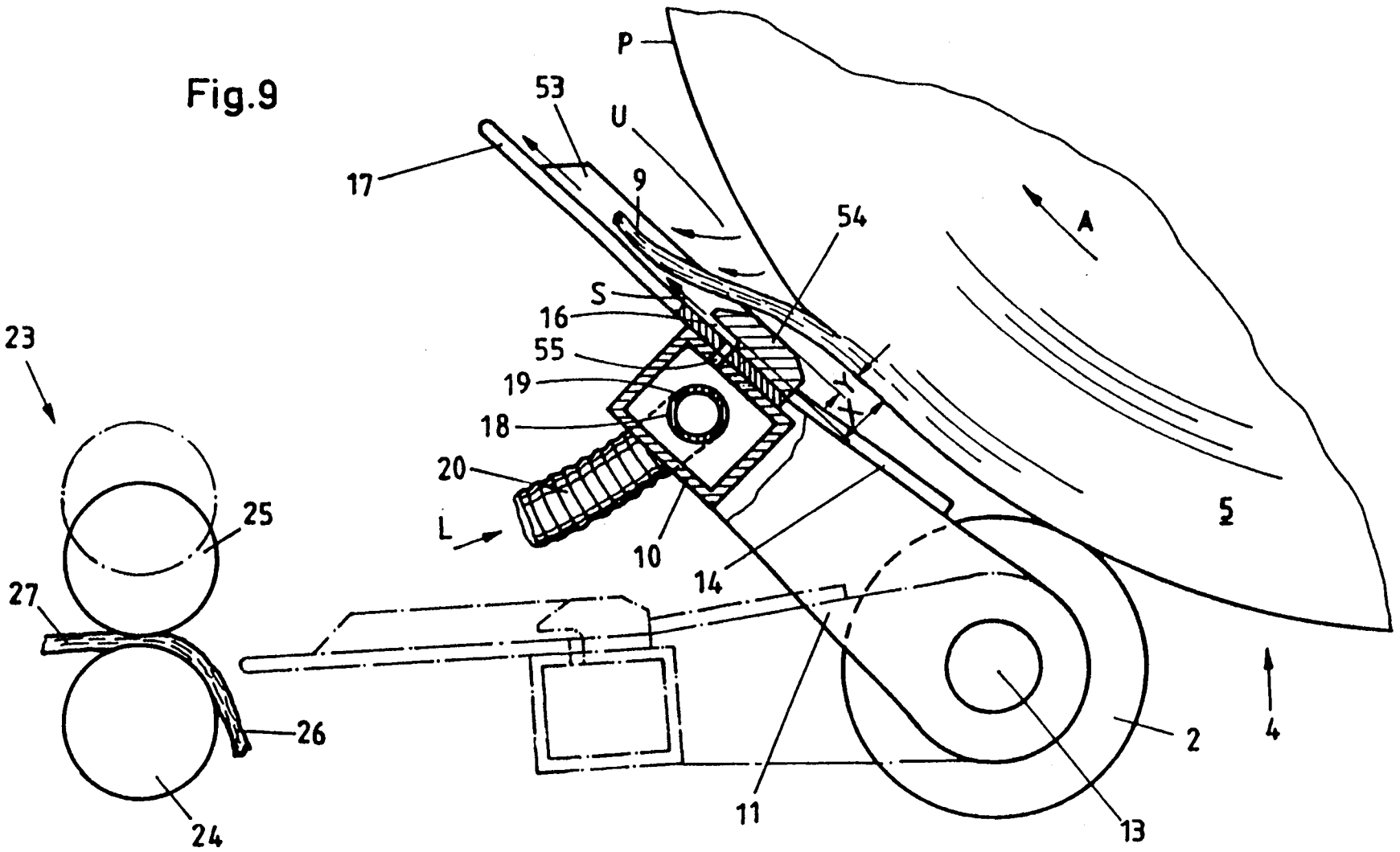
FIG. 9 illustrates a partial cross sectional view of a modified apparatus constructed in accordance with the invention.

Referring to FIG. 9, wherein like reference characters indicate like parts as above, the nozzle 10 may be constructed in the form of a square pipe having an outlet 55 directed towards the wadding lap 4. In addition, the guide plate 17 extending from the pipe has a slot aligned with the slot 55 of the pipe while a guide bar 54 is fixed to the plate 17 in overlying relation to the slot in order to form a slot 16 for directing the flow of air from the pipe 10 substantially tangentially of the wadding lap as described above.

As indicated in FIG. 9, the guide bar 54 which is secured with the nozzle 10 is spaced from the periphery of the wadding lap 4 by a preset distance Y while the slot 16 for producing the current of air S is spaced from the periphery of the wadding lap at a greater distance X than the preset distance Y. In this way, the spacing of the slot 16 is greater than the smaller spacing of the nozzle from the periphery of the wadding lap 4.

Figure 10:
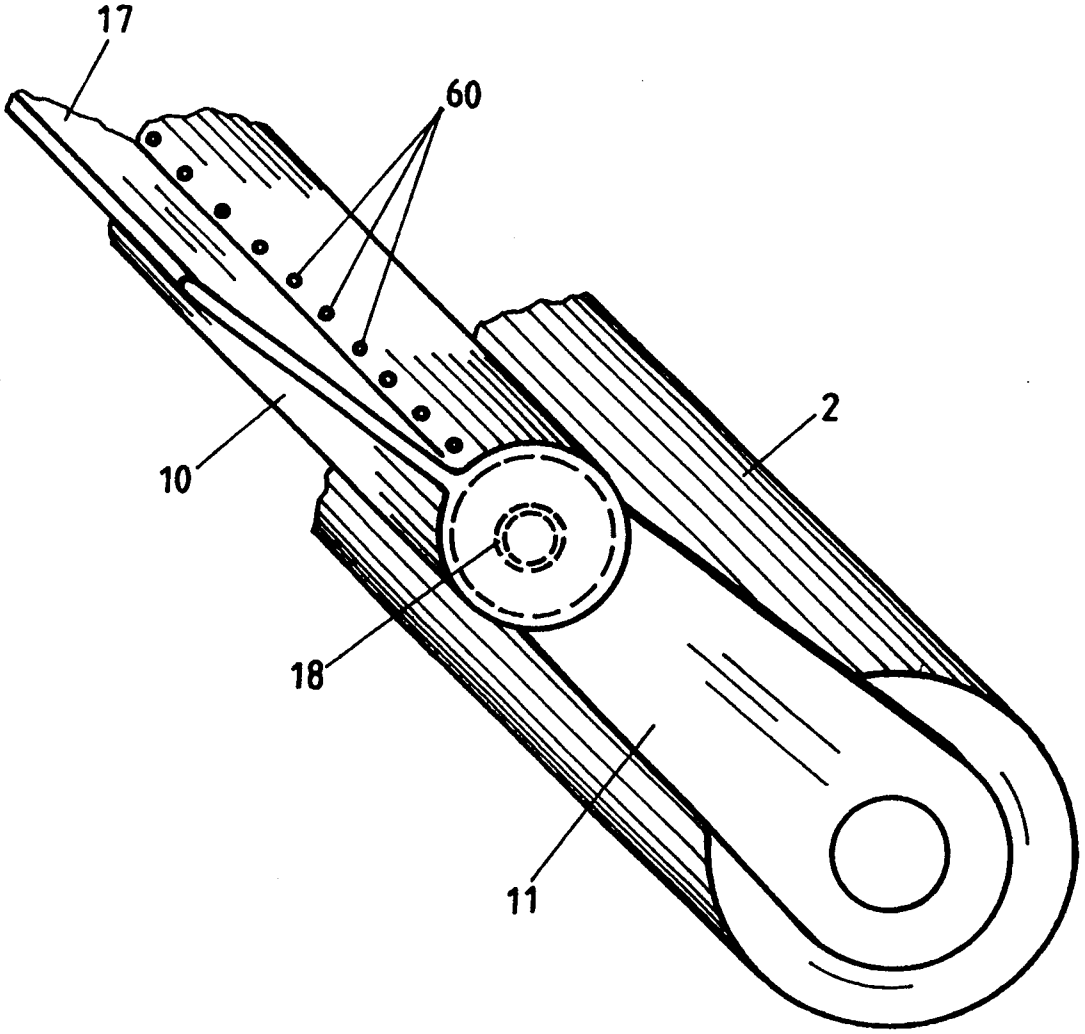
FIG. 10 illustrates a nozzle having a plurality of outlet openings in accordance with the invention.

Referring to FIG. 10, wherein like reference characters indicate like parts as above, the nozzle 10 may be provided with a plurality of outlet openings 60 to expel the current of air therethrough.

The invention thus provides a relatively simple technique which insures an automatic and functionally positive opening of a wadding lap for joining to the trailing end of a lap being run out in a joining apparatus.

What is claimed is:

1. In a method for detaching a leading end of wadding from a rolled-up wadding lap, the improvement comprising the steps of producing a current of air over the width of the wadding lap and in a direction substantially tangential of the wadding lap, spacing said current of air from the wadding lap to generate an air stream in an unrolling direction of the wadding lap, and detaching the leading end of a wadding from the wadding lap under the force of the air steam.

2. In the method as set forth in claim 1, the step of guiding the leading end of the wadding into a predetermined position for subsequent conveyance to a joining apparatus.

3. A method for opening a wadding lap comprising the steps of mounting a rolled-up wadding lap on a pair of lap rollers;

rotating the lap rollers to effect rotation of the wadding lap in a first direction about an axis thereof; and producing a current of air over the width of the wadding lap and in a direction substantially tangentially of the wadding lap and co-directionally with said first direction, said current of air being spaced from the periphery of the wadding lap to generate an air stream in an unrolling direction of the wadding lap to detach a start of a wadding from the wadding lap.

4. The method as set forth in claim 3 which further comprises the step of guiding the start of the wadding into a predetermined position for subsequent conveyance to a joining apparatus.

5. The method as set forth in claim 3 wherein said current of air flows in a planar pattern.

6. The method as set forth in clam 3 which further comprises the step of adjusting the speed of said current of air.

7. The method as set forth in claim 6 wherein the speed of said current of air is reduced after the start of wadding is detached from the wadding lap.

8. An apparatus for opening a wadding lap comprising a pair of lap rollers for receiving a rolled-up wadding lap thereon;

a drive for rotating said lap rollers to effect rotation of the wadding lap in a first direction about an axis thereof; and a nozzle for producing a current of air over the width of the wadding lap and in a direction tangentially of the wadding lap, said current of air being spaced from the periphery of the wadding lap to generate an air stream in an unrolling direction of the wadding lap, open a start of the wadding from a wadding lap.

9. The apparatus as set forth in claim 8 wherein said nozzle has a slot extending over the width of the wadding lap to expel said current of air therethrough,

10. The apparatus as set forth in claim 8 which further comprises a guide plate extending from said nozzle to guide said current of air and the start of the wadding thereon,

11. The apparatus as set forth in claim 10 wherein said guide plate is secured to said nozzle on a side of said current of air opposite the wadding lap.

12. The apparatus as set forth in claim 10 wherein said guide plate has a pair of upstanding side walls to guide said current of air therebetween.

13. The apparatus as set forth in claim 8 wherein said nozzle is spaced from the periphery of the wadding lap a preset distance and has at least one opening for producing said current of air spaced from the periphery of the wadding lap at a greater distance than said preset distance.

14. The apparatus as set forth in claim 8 wherein said nozzle is adjustably mounted relative to said lap rollers.

15. The apparatus as set forth in claim 14 wherein said nozzle is pivotally mounted to swivel about an axis of one of said lap rollers.

16. The apparatus as set forth in claim 8 further comprises a pressurized air source for supplying air to said nozzle, a control for controlling a supply of air from said source, means for pivoting said nozzle between a position adjacent the wadding lap and a position spaced from the wadding lap, and a control unit connected to said drive, said control and said switching means for synchronizing the operation thereof.

17. The apparatus as set forth in claim 8 wherein said nozzle includes a square pipe having an outlet directed towards the wadding lap and which further comprises a guide plate extending from said pipe with a slot aligned with said nozzle outlet and a guide bar fixed to said plate in overlying relation to said slot to direct a flow of air from said pipe tangentially of the wadding lap and over said guide plate.

18. The apparatus as set forth in claim 8 wherein said nozzle has a plurality of outlet openings to expel said current of air therethrough.

19. In combination, a nozzle for producing a current of air over the width of a rolled-up wadding lap and in a direction substantially tangentially of the wadding lap, said current of air being spaced from the periphery of the wadding lap to generate an air stream in an unrolling direction of the wadding lap to detach a start of a wadding from the wadding lap; and a joining apparatus for joining the start of the wadding from the wadding lap to a trailing end of a second wadding extending from said apparatus.

20. The combination as set forth in claim 19 which further comprises a guide plate extending from said nozzle to guide said current of air and the start of the wadding thereon and means for pivoting said guide plate between a first position adjacent the wadding lap and a second position spaced from the wadding lap to introduce the start of the wadding to said joining apparatus.

21. The combination as set forth in claim 20 wherein said guide plate is secured to said nozzle and said nozzle is pivotally mounted about an axis of one of said lap rollers.

* * * * *

UNITED STATES PATENT AND TRADEMARK OFFICE

CERTIFICATE OF CORRECTION

PATENT NO. : 5,337,456

DATED : Aug. 16, 1994

INVENTOR(S) : HEINZ CLEMENT

It is certified that error appears in the above-identified patent and that said Letters Patent is hereby corrected as shown below:

Column 9, line 21 change "switching" to -pivoting-

Signed and Sealed this

Eleventh Day of October, 1994

*Attest:*

Bruce Lehman

BRUCE LEHMAN

*Attesting Officer*

*Commissioner of Patents and Trademarks*